US012187477B2

(12) United States Patent
Salpe

(10) Patent No.: US 12,187,477 B2
(45) Date of Patent: Jan. 7, 2025

(54) DUAL LANE, PREMADE POUCH PACKAGING MACHINE

(71) Applicant: Abhijit Salpe, Parvati Pune (IN)

(72) Inventor: Abhijit Salpe, Parvati Pune (IN)

( * ) Notice: Subject to any disclaimer, the term of this patent is extended or adjusted under 35 U.S.C. 154(b) by 0 days.

(21) Appl. No.: 18/504,383

(22) Filed: Nov. 8, 2023

(65) Prior Publication Data

US 2024/0158122 A1 May 16, 2024

Related U.S. Application Data

(63) Continuation of application No. 18/491,064, filed on Oct. 20, 2023, which is a continuation of application No. PCT/IN2022/050379, filed on Apr. 21, 2022.

(51) Int. Cl.

| | |
|---|---|
| ***B65B 59/00*** | (2006.01) |
| ***B65B 41/04*** | (2006.01) |
| ***B65B 43/46*** | (2006.01) |
| ***B65B 65/00*** | (2006.01) |

(52) U.S. Cl.

CPC ..... *B65B 41/04* (2013.01); *B65B 43/465* (2013.01); *B65B 59/003* (2019.05); *B65B 65/006* (2013.01); *B65B 2210/04* (2013.01)

(58) Field of Classification Search

CPC ..... B65B 43/26; B65B 43/32; B65B 43/465; B65B 59/003; B65B 65/006; B65G 47/842; B65G 2201/0238

USPC ..... 53/570, 202

See application file for complete search history.

(56) References Cited

U.S. PATENT DOCUMENTS 3,568,402 A * 3/1971 Lense et al. ..... B65B 43/26 53/570
3,762,253 A 10/1973 Loomis, Jr. et al.
3,982,376 A * 9/1976 Ikeda ..... B65B 43/465 53/385.1

(Continued)

FOREIGN PATENT DOCUMENTS

WO WO-2023189985 A1 * 10/2023 ..... B65B 43/46

OTHER PUBLICATIONS

International Search Report and Written Opinion for PCT Patent Application No. PCT/IN2022/050379, published on Jul. 26, 2022, 11 pages.

*Primary Examiner* — Stephen F. Gerrity
(74) *Attorney, Agent, or Firm* — FisherBroyles, LLP; Susan M. Oiler

(57) ABSTRACT

Disclosed is a pick-fill-seal type dual lane premade pouch packing machine (200) that reduces the setup time and allows flexibility to change the gripper width as per the pouch size. The machine (200) comprises a plurality of gripper assemblies (150) linearly mounted on two indexing assemblies (110A, 110B) driven by two independent driving mechanisms wherein first gripper fingers (120) are mounted on the first indexing assembly (110A) and second gripper fingers (130) are mounted on the second indexing assembly (110B). Cam followers (140) are fitted on the gripper assemblies (150) either on upper side or lower side thereof such that gripper assemblies (150) with upper side cam-followers (140) and lower side cam-followers (140) are arranged alternately. The independence of cam motion from the indexing assemblies (110A, 110B) allows the indexing distance to be reduced which results in reduction in the machine length and the floor space required.

4 Claims, 3 Drawing Sheets

(56) References Cited

U.S. PATENT DOCUMENTS

| | | | | | |
|---|---|---|---|---|---|
| 4,108,300 | A * | 8/1978 | Hayase et al. | B65B 43/465 53/570 |
| 4,263,768 | A * | 4/1981 | Russell et al. | B65B 43/465 198/803.4 |
| 4,608,803 | A * | 9/1986 | Araki | B65B 43/465 53/202 |
| 5,564,252 | A * | 10/1996 | Adelmann | B65B 1/02 53/202 |
| 6,050,061 | A * | 4/2000 | Todd et al. | B65B 43/465 53/562 |
| 6,073,424 | A * | 6/2000 | Kraft et al. | B65B 43/465 53/570 |
| 6,571,532 | B1 | 6/2003 | Wiernicki et al. | |
| 8,151,543 | B2 * | 4/2012 | Veix | B65B 43/465 53/570 |
| 9,187,198 | B2 * | 11/2015 | Matheyka | B65B 43/465 |
| 10,351,281 | B2 * | 7/2019 | Garriga Jimenez et al. | B65B 43/465 |
| 11,053,039 | B2 * | 7/2021 | Sander et al. | B65B 43/465 |
| 2022/0315356 | A1 * | 10/2022 | Solà Gil | B65B 43/465 |

* cited by examiner

DUAL LANE, PREMADE POUCH PACKAGING MACHINE

RELATED APPLICATIONS

This application is a continuation of U.S. application Ser. No. 18/491,064, filed Oct. 20, 2023, which claims the benefit of the filing date of, pursuant to 35 U.S.C. 365(c), and is a continuation of International Patent Application No. PCT/IN2022/050379, filed on Apr. 21, 2022, which designated the United States and which claims the benefit of Indian Patent Application No. 202121018601, filed Apr. 22, 2021, the entire disclosure of which is incorporated herein by reference.

FIELD OF INVENTION

The present invention generally relates to packaging machines and more particularly it relates to dual lane pick fill seal machine used for packaging of pre-made pouches.

BACKGROUND OF THE INVENTION

Pick fill seal machines are commonly used in packaging industry for filling and sealing of premade pouches. Mostly the machines are made of 8 to 10 stations with each station having one or more functions mentioned above. Although the machines are very popular they have a restricted speed because of the mechanics involved. The mechanics of this type of machine is very complicated and difficult to fine tune. Also, the layout also puts a limitation on the output of the machine which can be achieved in a particular floor space and thus results in a poor cost to performance ratio.

The dual lane pick-fill-seal machines available in the market solve the problem of production output and able to provide a very quick return on investment but typically can only be used for one or two sizes of the pouch. The Carousal Type construction also allows for opportunities to make a dual lane construction which in turn gives the best cost to performance ratio for Pick Fill Seal machines. However, there are also certain drawbacks in commonly available carousal type Pick Fill Seal machines. The first one being the changeover time required. Gripper holds the pouches and hence has to be adjusted according to the pouch width. Whenever the pouch size changes the gripper width has to be adjusted accordingly. In most carousal type machines this is a manual operation and consumes lot of time. Another drawback being the large amount of floor space required for this type of machines. Accordingly, there exists a need to provide a pick fill sealing machine that will that will overcome the deficiencies of prior art by reducing the setup time and allowing flexibility to change the gripper width as per the pouch size.

OBJECTS OF THE INVENTION

Object of the present invention is to reduce the set-up time and allow flexibility to change the gripper width as per the pouch size, in pick-fill-seal machines.

Another object of the present invention is to reduce the footprint of the pick-fill-seal machine by using dual cams/multiple cams for activating the grippers for pouch opening and closing operation.

Still another object of the present invention is to improve the cost to performance ratio of pick-fill-seal machines.

SUMMARY OF THE INVENTION

Accordingly, the present invention provides a dual lane premade pouch packaging machine that reduces the setup time and allows flexibility to change the gripper width as per the pouch size. The dual lane premade pouch packaging machine comprises a first indexing assembly and a second indexing assembly running in synchronization with each other and driven by two independent driving mechanisms, preferably servo motors. In an embodiment, the indexing assemblies are driven by a common drive with a mechanism to adjust the distance between the first gripper finger and the second gripper finger. A plurality of gripper assemblies, each serving as a station for performing basic operations related to pouch packaging are mounted on two indexing assemblies. Each gripper assembly from the plurality of gripper assemblies consists of consecutively mounted first gripper finger and a second gripper finger, each having a right hand side (RHS) gripping profile and a left hand side (LHS) gripping profile. Two consecutively mounted first gripper finger and second gripper finger together form two gripping units on either sides of the indexing assemblies: a first gripping unit (A) formed with two RHS gripping profiles and a second gripping unit (B) formed with two LHS gripping profiles. A cam follower is mounted on each of the gripping profile of the first and the second gripping units (A, B) either on upper side or on the lower side thereof. At least one top cam and at least one bottom cam are arranged in the machine for operating upper and lower mounted cam followers of the gripping profiles. Specifically, the gripper assemblies having all upper-mounted cam followers and gripper assemblies having all lower-mounted cam followers are arranged alternately; and the plurality of a gripper assemblies are linearly arranged on the indexing assemblies with first gripper fingers mounted on the first indexing assembly and second gripper fingers mounted on the second indexing assembly, wherein the indexing assemblies move in synchronization to each other, maintaining the width of gripping units (A, B) constant for all the gripper assemblies, and the width of gripping units (A, B) is adjusted according to the pouch width by linearly moving either of the indexing assembly. The independence of cam motion from the indexing assemblies allows the indexing distance to be reduced which results in reduction in the machine length and the floor space required.

BRIEF DESCRIPTION OF THE DRAWINGS

The objects and advantages of the present invention will become apparent when the disclosure is read in conjunction with the following figures, wherein.

DETAILED DESCRIPTION OF THE INVENTION

The foregoing objects of the invention are accomplished, and the problems and shortcomings associated with prior art techniques and approaches are overcome by the present invention described in the present embodiments. However, it is to be understood that the disclosed embodiments are merely exemplary of an invention that may be embodied in various and alternative forms. Therefore, specific functional details disclosed herein are not to be interpreted as limiting, but merely as a representative basis for the claims and/or as a representative basis for teaching one skilled in the art to variously employ the present invention. The following description is presented to enable any person skilled in the art to make and use the invention, and is provided in the context of particular applications of the invention and their requirements.

Accordingly, the present invention is related to a type of packaging machine which is used for packaging of pre-made pouches. These types of machines are described as pick-fill-seal machines. Pick-fill-seal machines are commonly used in packaging industry for filling and sealing of premade pouches. The present invention provides dual lane premade pouch packaging machine having compact design with a substantially smaller footprint and complete flexibility to change according to the production requirement. The present invention is about carousal type linear pick-fill-seal machines.

The present invention is illustrated with reference to the accompanying drawings, throughout which reference numbers indicate corresponding parts in the various figures. These reference numbers are shown in bracket in the following description and in the table below.

TABLE:

| Ref No: | Component | Ref No: | Component |
|---|---|---|---|
| 100 | Rotary pick-fill-seal machine of prior art | 130 | Second gripper finger |
| 200 | Dual lane premade pouch packaging machine | 130A | RHS second gripper finger |
| 110A | First indexing assembly | 130B | LHS second gripper finger |
| 110B | Second indexing assembly | A | First gripping unit |
| 120 | First gripper finger | B | Second gripping unit |
| 120A | RHS first gripper finger | 140 | Cam follower |
| 120B | LHS first gripper finger | 150 | Gripper assembly/station |

Figure 1:
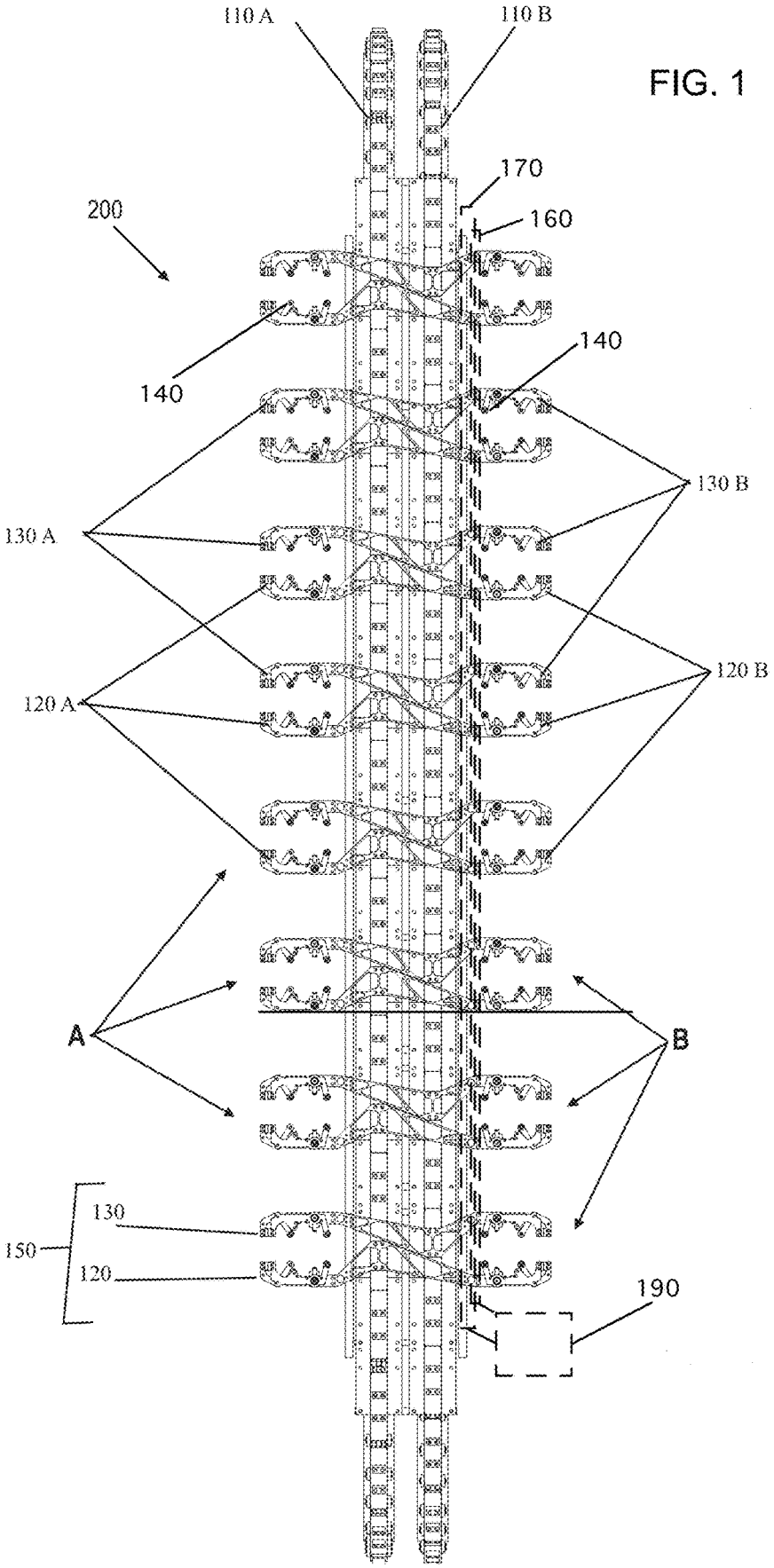
FIG. 1 shows indexing assemblies of dual lane machine with automated changeover and alternate CAM follower arrangement, in accordance with one of the embodiments of the present invention.
Figure 2:
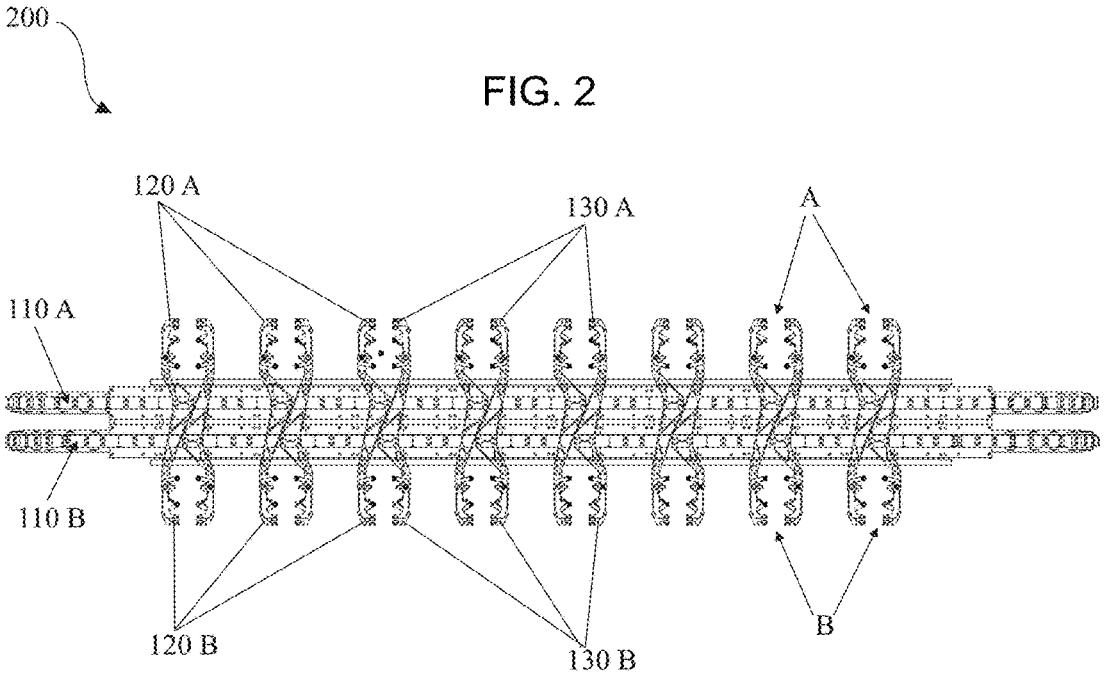
FIG. 2 shows top view of the basic operational layout of linear carousal type dual lane pick-fill-seal machine, in accordance with one of the embodiments of the present invention.
Figure 3:
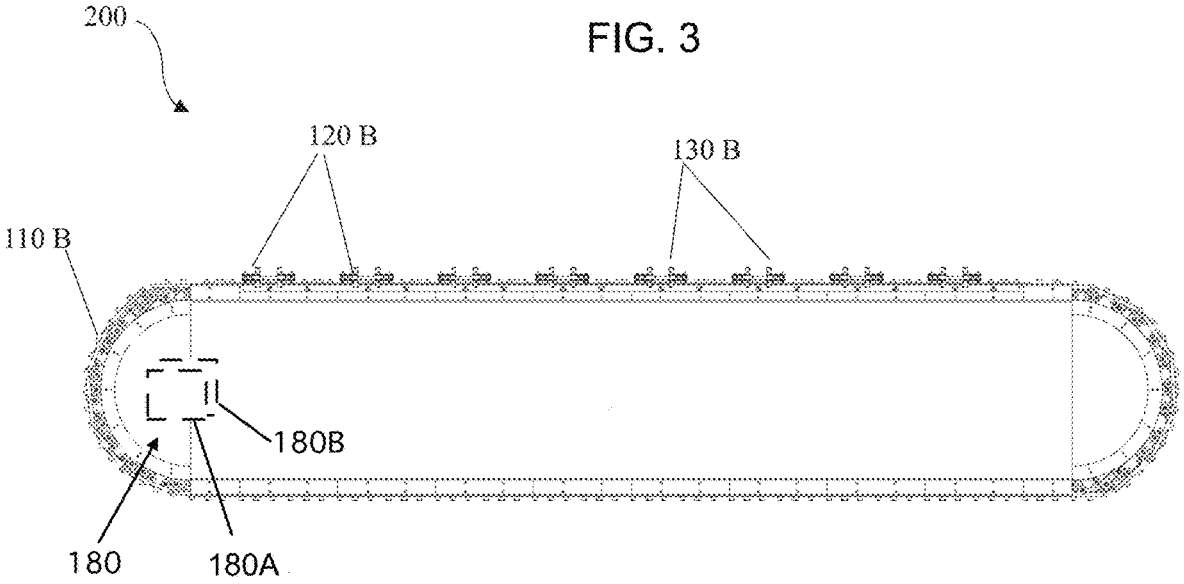
FIG. 3 shows front view of the basic operational layout of linear carousal type dual lane pick-fill-seal machine, in accordance with one of the embodiments of the present invention.
Figure 4:
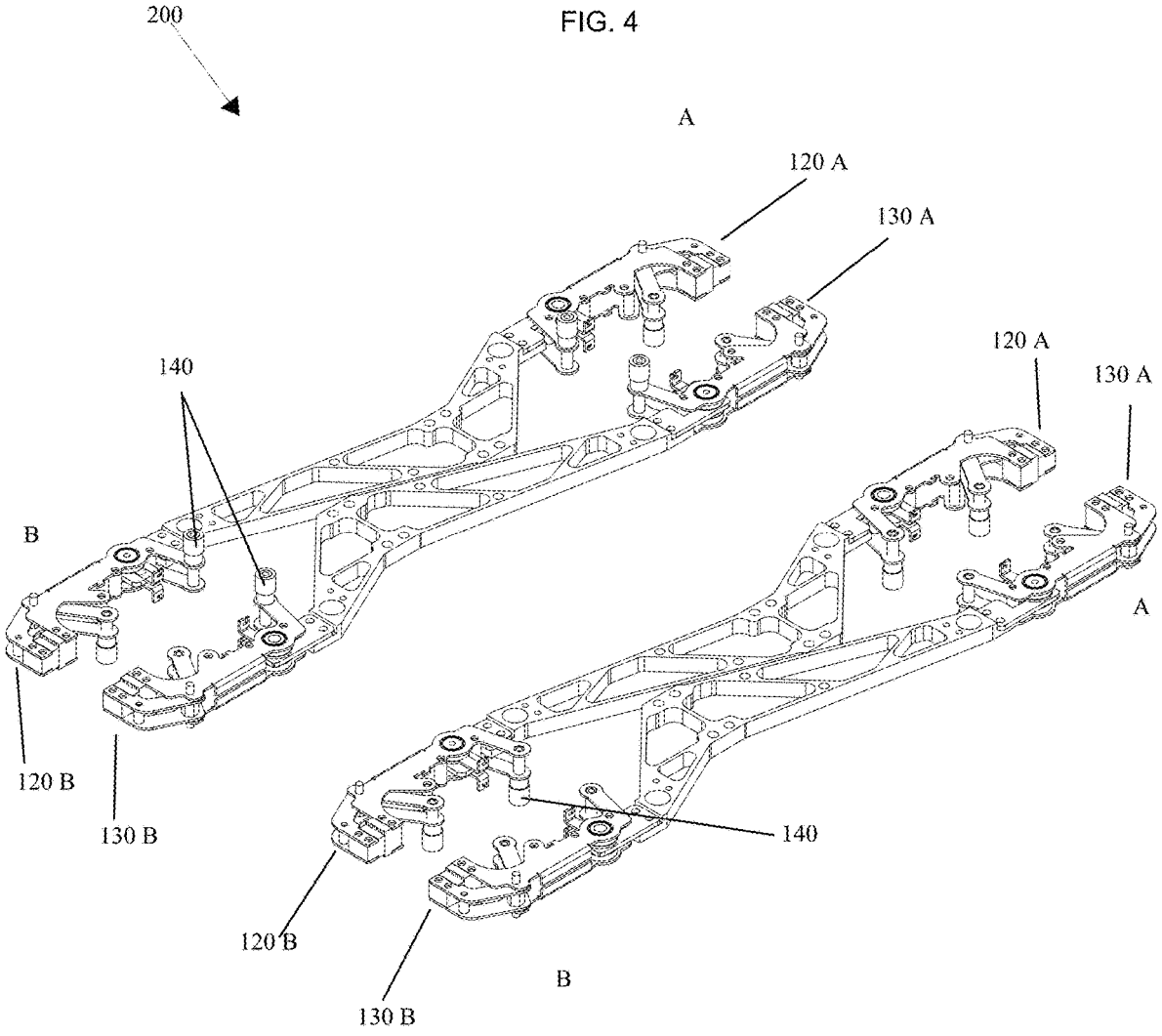
FIG. 4 shows detailed view of two consecutive station assemblies respectively with top cam followers and bottom cam followers, in accordance with one of the embodiments of the present invention.

Referring to FIGS. 1 to 4, a basic set up of a dual lane premade pouch packaging machine (200) (hereinafter referred as 'the machine (200)') is shown. The machine (200) consists of a plurality of gripper assemblies (150)/stations (150) mounted on a first indexing assembly (110A) and a second indexing assembly (110B).

The machine (200) involves lot of other assemblies the construction and the details of them are out of the scope of this patent. The first indexing assembly (110A) and the second indexing assembly (110B) running in synchronization with each other are driven by two independent servo motors (collectively referred as 180), specifically servo motor on RHS side (180A) and servo motor on LHS side (180B). Each gripper assembly serves as a station for performing basic operations related to pouch packaging e.g. pouch sorting/singling; pouch pickup and placement in the grippers, date coding, pouch opening along with zipper, pouch bottom/gusset opening, checking if the pouch is opened correctly, filling the pouch with the product to be packed using an appropriate filler, sealing the pouch, etc. the machine (200) is generally provided with 8 to 10 stations/gripper assemblies (150) with each station having one or more functions mentioned above. In an exemplary embodiment of eight station pouch packing machine, the pouches are infeed to the machine at station I using any suitable infeed mechanism. At second station, the pouch is opened with help of vacuum cups. Station 3 is a pouch checking station where it is ensured that the pouch is opened correctly. Station 4 is a filling station where a pre-set quantity of the material is dispensed in the pouch using appropriate fillers. Station 5 is a spare station which can be used for any extra operations required. Station 6 is a pouch straightening station, Station 7 is a sealing station where the top of the pouch is sealed normally using a heat sealer/ultrasonic sealer. The pouch then exits the machine at Station 8. The number of stations can be extended to as many stations as required for the application.

Each gripper assembly from the plurality of gripper assemblies (150) consists of a First gripper finger (120) and a second gripper finger (130). Each gripper finger (120 and 130) is having a right hand side (RHS) gripping profile and a left hand side (LES) gripping profile. Referring to FIGS. 2 to 5, the RHS gripping profile of the first and the second gripper finger (120 and 130) is respectively denoted as 120A and 130A while the LHS gripping profile of the first and the second gripper finger (120 and 130) is respectively denoted as 120B and 130B. Two consecutively mounted first gripper finger (120) and second gripper finger (130) together form two gripping units on either sides of the indexing assemblies: a first gripping unit (A) formed with two RHS gripping profiles (120A and 130A) and a second gripping unit (B) formed with two LHS gripping profiles (120B and 130B). All the pouch operations are simultaneously performed on both the LHS and the RHS gripping units (A and B).

The width of gripper units, i.e. distance between two RHS gripping profiles (120A and 130A) or two LEIS gripping profiles (120B and 130B) is decided as per the pouch width.

In a specific embodiment, the plurality of a gripper assemblies (150) are linearly arranged on the indexing assemblies (110A, 110B) with plurality of first gripper fingers (120) mounted on the first indexing assembly (110A) and plurality of second gripper fingers (130) mounted on the second indexing assembly (110B). When the machine (200) is in operation, both the indexing assemblies (110A, 110B) move in synchronization to each other maintaining width of the gripper units (A, B) constant for all the stations/gripper assemblies (150). Adjusting the width of the gripper units (A, B) according to the pouch width is achieved by linearly moving either of the indexing assembly (110A or 110B) with the servo motor (180). In an embodiment, the indexing assemblies (110A and 110B) can be driven by independent drives or a common drive with a mechanism to adjust the distance between the first gripper finger (120) and the second gripper finger (130).

A cam follower (140) is mounted on each of the RHS and LHS gripping profile of the first gripper finger (120) and the second gripping finger (130), either on upper side or on the lower side thereof, Thus, each gripper assembly from the plurality of gripper assemblies (150) is having four cam followers mounted thereon. It is to be understood here that each gripper assembly from the plurality of gripper assemblies (150) is having all four cam followers mounted on the same side i.e. either on the upper side or on the lower side. The plurality of gripper assemblies (150) is arranged with alternate gripper assemblies (150) having upper-mounted cam followers (140) and lower-mounted cam followers (140). At least one top cam (160) and at least one bottom cam (170) are arranged in the machine (200) to operate in synchronization with the cam followers (140) for providing swiveling or tilting the gripper fingers (120, 130) so as to aid in the pouch opening process. This is a very critical function and has to be carried out in synchronization with lot of other assemblies. The top cams are for swiveling the gripper fingers (120, 130) with the upper-mounted cam followers (140) and the bottom cams are for swiveling the gripper fingers (120, 130) with the lower-mounted cam followers (140). In the pouch straightening process, cams are kept stationary and the indexing assemblies (110A, 110B) are moved. In an embodiment, the top cams (160) and the bottom cams (170) are pneumatically operated (pneumatic operator (190).

The alternate arrangement of upper and lower cam followers (140) and the arrangement of top cams (160) and bottom cams (170) in the machine (200) greatly simplifies the construction of the machine (200) as the cams are required to operate alternately once in every two cycles and don't need synchronisation with the indexing assemblies (110A, 110B). The independence of CAM motion from the indexing assemblies (110A, 110B) also allows the indexing distance to be drastically reduced which results in reduction in the machine length and the floor space required.

Advantages of the Additive Composition of Present Invention

- The machine (200) reduces the cost to output/performance ratio of Pick Fill Seal machine drastically.
- The machine (200) also makes it possible to completely perform the gripper changeover automatically. This reduces the possibility of operator error and the time required to complete the changeover.
- The machine (200) also reduces the foot print of the machine and enables the optimum use of floor space.
- The machine (200) provides complete flexibility to change the gripper width according to pouch sizes and the production requirement.
- In machine (200), the pouch operations can be simultaneously performed on both the LHS and the RHS gripping units.
- The independence of CAM motion from the indexing assemblies (110A, 110B) allows the indexing distance to be drastically reduced which results in reduction in the machine length and the floor space required.

The forgoing objects of the invention are accomplished and the problems and shortcoming associated with prior art techniques and approaches are overcome by the present invention described in the present embodiment. Detailed description of the preferred embodiment is provided herein; however, it is to be understood that the present invention may be embodied in various forms. Therefore, specific details disclosed herein are not to be interpreted as limiting, but rather as a basis for the claims and as representative basis for teaching one skilled in the art of employ the present invention in virtually any appropriately detailed system, structure, or matter. The embodiments of the invention as described above and the methods disclosed herein will suggest further modification and alterations to those skilled in the art. Such further modification and alterations may be made without departing from scope of the invention.

The invention claimed is:

1. A dual lane premade pouch packaging machine (200) comprising:

a first indexing assembly (110A) and a second indexing assembly (110B) running in synchronization with each other and driven by two independent driving mechanisms;

a plurality of gripper assemblies (150), each serving as a station for performing basic operations related to pouch packaging; each gripper assembly from the plurality of gripper assemblies (150) consisting of consecutively mounted first gripper finger (120) and a second gripper finger (130), wherein each gripper finger (120 and 130) is having a right hand side (RHS) gripping profile (120A, 130A) and a left hand side (LHS) gripping profile (120B, 130B) respectively forming first gripping unit (A) and second gripping unit (B) on either sides;

a cam follower (140) mounted on each of the gripping profile of the first and the second gripping units (A, B) either on upper side or on the lower side thereof; and at least one top cam (160) for operating the upper-mounted cam followers (140) and at least one bottom cam (170) for operating the lower-mounted cam followers (140);

characterized in that, the plurality of a gripper assemblies (150) are linearly arranged on the indexing assemblies (110A, 110B) with first gripper fingers (120) mounted on the first indexing assembly (110A) and second gripper fingers (130) mounted on the second indexing assembly (110B), wherein the indexing assemblies (110A, 110B) move in synchronization to each other, maintaining the width of gripping units (A, B) constant for all the gripper assemblies (150), and the width of gripping units (A, B) is adjusted according to the pouch width by linearly moving either of the indexing assembly (110A or 110B); and the plurality of gripper assemblies (150) is arranged with gripper assemblies (150) having all upper-mounted cam followers (140) and gripper assemblies (150) having all lower-mounted cam followers (140) arranged alternately.

2. The dual lane premade pouch packaging machine (200) as claimed in claim 1, wherein the indexing assemblies (110A and 110B) are driven by a servo motor (180).

3. The dual lane premade pouch packaging machine (200) as claimed in claim 1, wherein the indexing assemblies (110A and 110B) are driven by a servo motor comprising a mechanism to adjust the distance between the first gripper finger (120) and the second gripper finger (130).

4. The dual lane premade pouch packaging machine (200) as claimed in claim 1, wherein the at least one top cam (160) and the at least one bottom cam (170) are pneumatically operated.

* * * * *